US005798061A

United States Patent [19]

Gaddis

[11] Patent Number: 5,798,061

[45] Date of Patent: Aug. 25, 1998

[54] DEVICE FOR MIXING TWO FLUIDS

[75] Inventor: Edward Shafik Gaddis, Clausthal-Zellerfeld, Germany

[73] Assignee: Air Products and Chemicals, Inc., Allentown, Pa.

[21] Appl. No.: 750,034

[22] PCT Filed: Mar. 31, 1995

[86] PCT No.: PCT/DE95/00451

§ 371 Date: Mar. 19, 1997

§ 102(e) Date: Mar. 19, 1997

[87] PCT Pub. No.: WO95/32795

PCT Pub. Date: Dec. 7, 1995

[30] Foreign Application Priority Data

May 26, 1994 [DE] Germany ..... 44 18 287.2

[51] Int. Cl.[6] ..... B01F 3/04

[52] U.S. Cl. ..... 261/77; 261/DIG. 75

[58] Field of Search ..... 261/77, DIG. 75

[56] References Cited

U.S. PATENT DOCUMENTS

| | | | |
|---|---|---|---|
| 2,597,422 | 5/1952 | Wood . | |
| 3,391,908 | 7/1968 | MacDonald . | |
| 3,538,933 | 11/1970 | Miller . | |
| 4,300,924 | 11/1981 | Coyle | 261/77 |
| 4,482,524 | 11/1984 | Hardison | 261/77 |
| 4,533,254 | 8/1985 | Cook et al. . | |
| 4,906,363 | 3/1990 | Makino et al. | 261/77 |
| 5,364,530 | 11/1994 | Gaddis . | |

FOREIGN PATENT DOCUMENTS

| | | |
|---|---|---|
| 3818991 | 11/1989 | Germany . |
| 1462603 | 1/1977 | United Kingdom . |
| 2063695 | 10/1981 | United Kingdom . |

*Primary Examiner*—Tim R. Miles
*Attorney, Agent, or Firm*—Ratner & Prestia

[57] ABSTRACT

A device for mixing two fluids, of which at least one is a liquid, which has a tubular vessel open on both axial ends for receiving the fluids, at least two nozzles which are separated from one another in space for supplying the fluids and a guide device one end of which communicates with the nozzles. At a location approximately in the middle of the guide device, it discharges into the vessel, the vessel surrounding at this point an impact zone in which fluid streams emerging from the guide device impact each other. The guide device is joined securely to the vessel and, one of the walls of the guide device defining a closed passage is the wall of the vessel.

13 Claims, 5 Drawing Sheets

FIG. 3
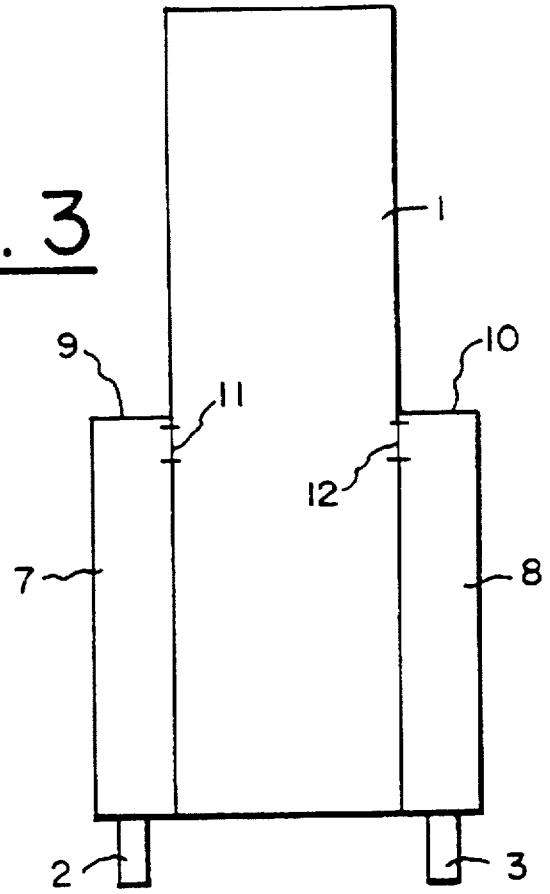
FIG. 4
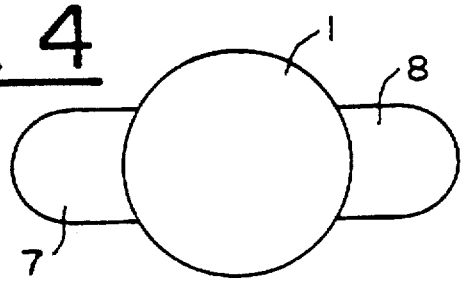
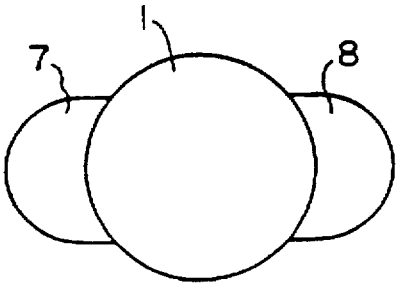
FIG. 2

DEVICE FOR MIXING TWO FLUIDS

This application is the U.S. national-phase application of PCT International Application No. PCT/DE95/00451.

BACKGROUND OF THE INVENTION

The invention relates to a device for mixing two fluids, of which at least one is a liquid.

"Fluids" for the purposes of the invention are liquids and gases. The device can be used for mixing a liquid with a gas or for mixing two mutually insoluble liquids or for mixing or homogenization of two mutually soluble liquids. The following details apply, representatively, also for the other two possibilities to the mixing of a liquid with a gas.

Such "mixing" is done, for example, in waste water treatment when as much oxygen as possible is to be introduced into the water, the oxygen being poorly soluble in water. To do this it is necessary, as in chemical reactions and in absorption and desorption processes between a gas and a liquid, to create a large mass exchange surface between the two fluids with high turbulence. The mass exchange between the gas and liquid is thus intensified.

With the known device according to DE 38 18 991 C1 mass exchange is further improved during mixing of fluids. The gas is broken up into very small bubbles as it emerges from the nozzles by the shear field of the liquid in the immediate region behind the openings of the nozzles. At the same time, from the interior of the vessel each liquid jet emerging from the nozzles sucks in liquid or a gas-liquid mixture. In this way, behind the nozzles homogeneous two-phase flows form. The two two-phase flows are routed such that they collide in the impact zone within the vessel. There the gas bubbles are further broken up and the kinetic energy of the flowing gas-liquid mixture is dissipated. In this way high turbulence and a large mass exchange surface in the impact zone as well as in the other parts of the vessel are produced above and below the impact zone.

The problem to be solved is to provide a simple structure for the device described above.

SUMMARY OF THE INVENTION

This device according to the present invention is made in one piece with the tube and guide channel. It can be produced in a compact construction and is therefore easy to handle. For this reason the device can be used, for example, also as an immersion assembly for large volume liquid tanks, in addition to its direct use as a mixing device.

The guide channel is made simply since the wall of the tube which is present anyway is used for its construction. Therefore only the second walls of the guide channel each need to be positioned inside or outside the tube and need to be securely joined to the tube.

In this case, for each nozzle used in the device a type of its own guide tube can be mounted. However, it is also possible to provide an annular guide channel with a correspondingly large number of nozzles.

Other advantageous embodiments of the invention involve the use of a dual cavity guide channel each bordered by half-pipes located outside of the tube, two cavities bordered by U-shape hollow sections located outside of but connected to the wall of the tube, use of a pipe piece concentric to and supported by the tube, integration of a gas supply pipe into the nozzles, and use of the device as an immersion assembly for a large volume liquid tank.

Embodiments of the subject matter of the invention are described in the drawings.

BRIEF DESCRIPTION OF THE SEVERAL VIEWS OF THE DRAWINGS

FIG. 2 shows a top view of the device.

FIG. 3 shows a side view of the device.

FIG. 4 shows an embodiment of the device which is modified compared to FIG. 2.

DETAILED DESCRIPTION OF THE INVENTION

Figure 1:
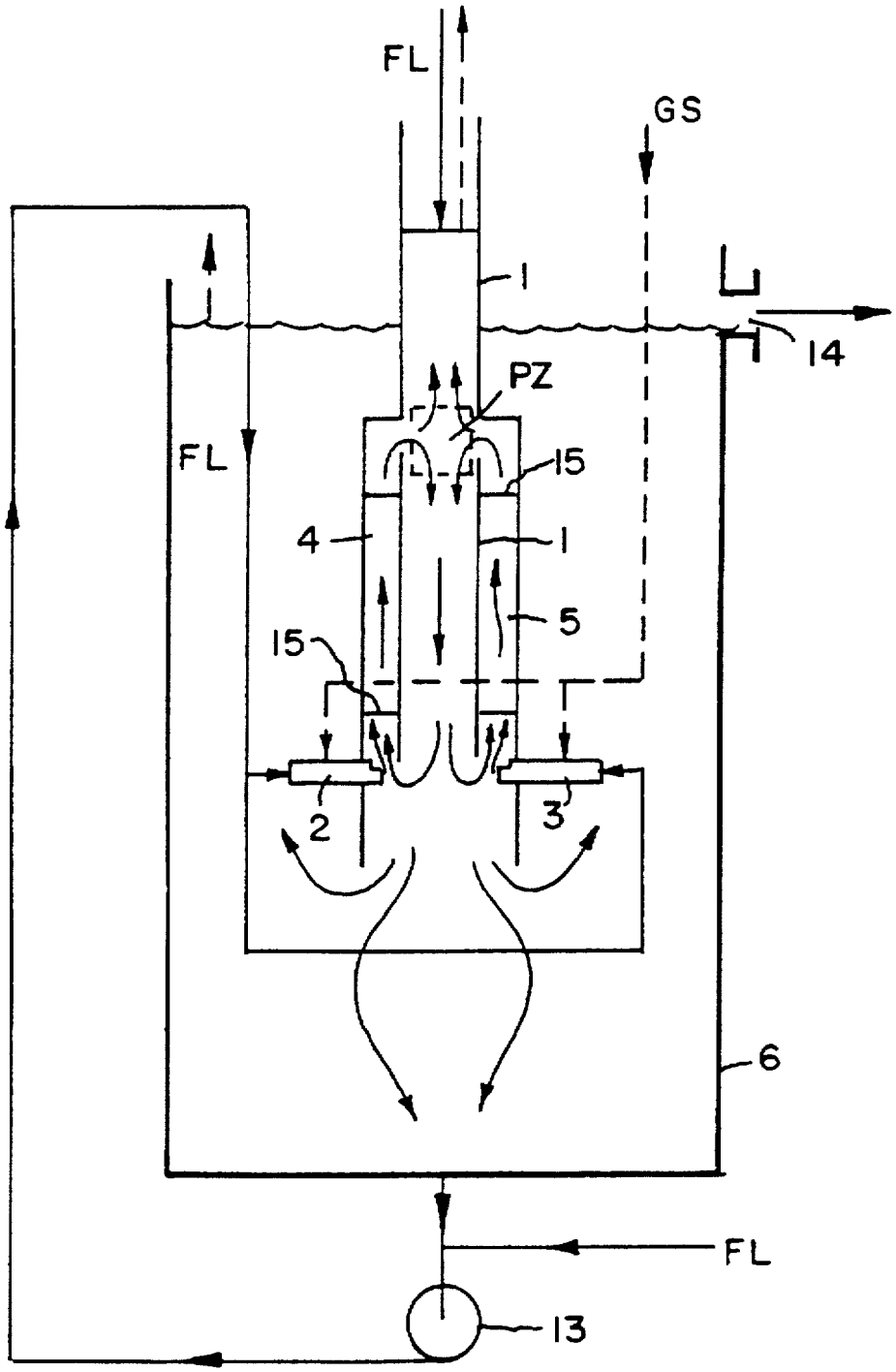
FIG. 1 shows a schematic view of a device according to the invention.

In the following description the device according to the invention is further described for the mixing of a liquid with a gas. In the same way, however, the device can also be used for mixing two mutually insoluble liquids or for homogenizing two mutually soluble liquids.

In a tubular vessel 1, which is open at both axial ends and which is preferably formed as a longitudinally extended cylinder, a gas GS and liquid FL are to be mixed with one another. In doing so, for example, as large an amount of oxygen as possible should be introduced into the liquid FL. At one end of the vessel 1—in the shown embodiment the lower end—two nozzles 2 and 3 are located, to which on the one hand the liquid FL and on the other hand the gas GS are supplied. The nozzles 2 and 3 are arranged here such that the jets of liquid and gas emerging from them enter guide tubes 4 and 5 of a guide device which for their part discharge into the vessel 1 at two points which are diametrically opposite one another. The vessel 1 including the guide tubes 4 and 5 as well as the nozzles 2 and 3 are inserted into a large volume tank 6 in which, for example, waste water is present as the liquid.

The device can, for example, be structured according to FIGS. 2 and 3. In this embodiment of the device two bent, closed walls 7 and 8 are attached at both axial edges to the exterior of the vessel 1, which each are securely joined with the wall of the vessel 1 forming an axially extending cavity. The walls 7 and 8 are closed according to FIG. 3 at the faces of their ends 9 and 10. At the other, open ends the nozzles 2 and 3 project into the cavities surrounded by the walls 7 and 8 as well as by the wall of the vessel 1. The walls 7 and 8 form together with the wall of the vessel 1 the guide means which consists here of the guide tubes 4 and 5 explained in connection with FIG. 1. In the area of the ends 9 and 10 of the walls 7 and 8 the wall of the vessel 1 is respectively breached. The corresponding holes 11 and 12 in the wall of the vessel 1 are each indicated in FIG. 3 by two strokes. Vessel 1 and walls 7 and 8 consist, for example, of plastic or metal.

The walls 7 and 8 can be bent, for example, in the shape of a semi-circle according to FIG. 2. They consist then expediently of half tubes. However hollow sections bent in a U-shape can be used for the walls 7 and 8 according to FIG. 4.

The guide tubes 4 and 5 extend essentially parallelly to the vessel 1. The two jets of liquid and gas routed separately in the guide tubes 4 and 5 collide in the vessel 1 in an impact zone PZ bordered by a broken line. The nozzles 2 and 3 suck liquid or a gas-liquid mixture from the area of the lower end of the vessel 1 and thus provide for an internal circuit indicated by the arrows drawn into FIG. 1. The liquid FL is delivered to the vessel 1 from above or in an external circulation, for example, by a pump 13. After separation the liquid can run off from an overflow 14 from the tank 6. The excess gas can emerge from the device in part through the vessel 1 and in part through the tank 6.

FIG. 1 shows two nozzles 2 and 3. However, more than two nozzles each separated from one another can also be used. The nozzles 2 and 3 are preferably formed as two-component nozzles of two concentric pipes. With respect to geometry and dimensions they are preferably identical so that two or more uniform streams of liquid and gas are delivered to the vessel 1. If more than two nozzles are used, the discharge sites of the corresponding guide tubes are preferably arranged uniformly offset on the periphery of vessel 1. Thus, for three nozzles there is an angle of 120° each between the discharge sites.

The device according to FIGS. 1 to 4 operates essentially as follows.

A liquid FL and a gas GS are supplied separately via nozzles 2 and 3. As a result of the shear field of the liquid FL on the exit openings of the nozzles 2 and 3 the gas GS is dispersed. The gas bubbles are entrained by the liquid FL and the resulting two-component mixture collides in two streams in the impact zone PZ. The gas bubbles are thus further dispersed so that increased mass exchange takes place. A large portion of the gas bubbles remains suspended in the impact zone PZ and is thus continuously further dispersed. This leads to an additional increase of mass exchange. The impact zone PZ for this reason is located as centrally as possible in vessel 1, therefore roughly in its center.

In another embodiment of the device different from the embodiments according to FIGS. 2 to 4 the lower part of the vessel 1 can also be surrounded by a tube piece extending with a space concentrically to the same. The nozzles 2 and 3 discharge then into an annular space. The corresponding guide device is restricted externally by the tube piece and internally by the wall of the vessel 1. Since the breach of the vessel 1 at the level of the impact zone PZ extends then also circularly, the lower part of the vessel 1 is expediently connected with the concentric tube piece. Schematically shown crosspieces 15 can be used for this purpose, for example, which are securely joined to the lower part of the vessel 1 and the tube piece. The tube piece is itself securely and peripherally joined tightly to the upper part of the vessel 1. The guide means is structured in this case thus annularly. It is restricted by the vessel 1 on the one hand and the tube piece on the other hand which represent the walls of the guide means. In this embodiment of the device expiediently more than two nozzles are used. Preferably four nozzles are used which are offset each by 90° in the peripheral direction. The number of nozzles is, however, arbitray here, too.

Figure 5:
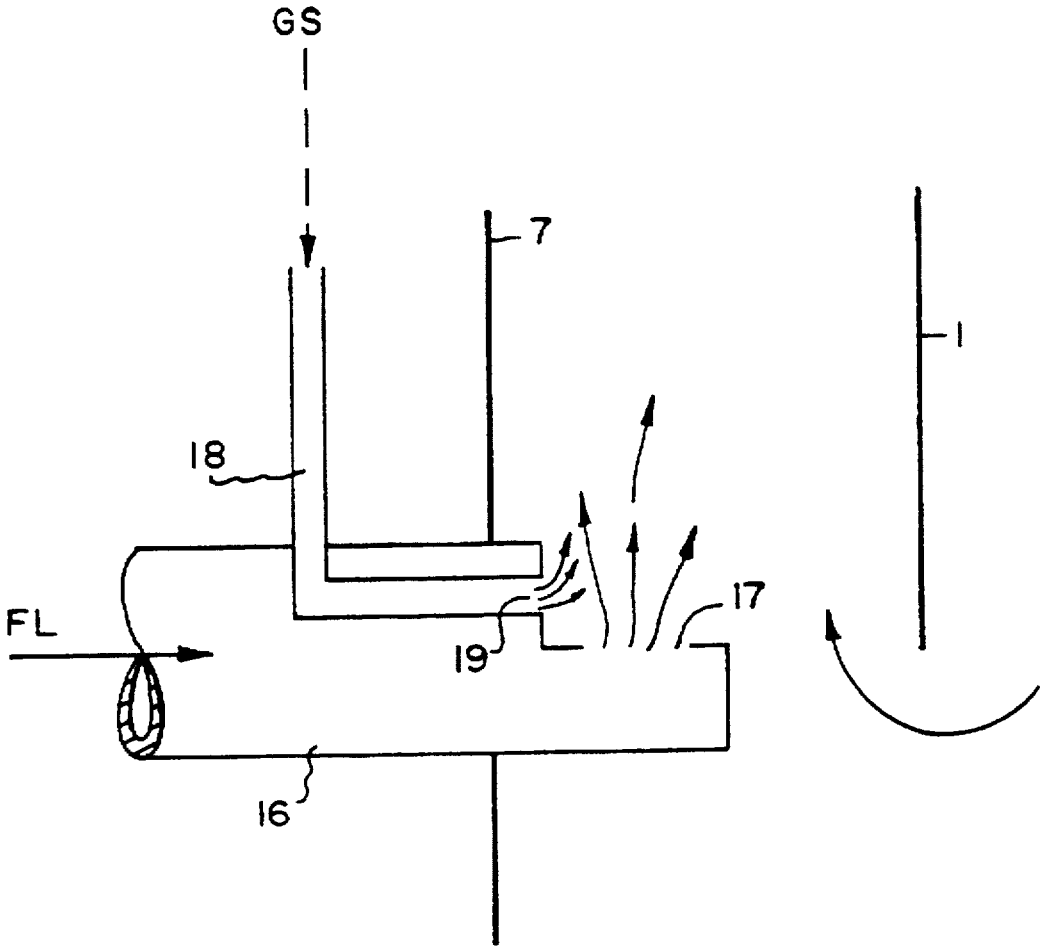
FIG. 5 shows a nozzle which can be used in the device in an enlarged representation.

The nozzles can be arranged according to FIG. 1 such that their bodies project in radial direction into the guide means. The structure of one such nozzle follows, for example, from FIG. 5 in an enlarged representation. It consists of a pipe 16 which has a nozzle opening 17 in its peripheral surface. The liquid FL supplied by the pipe 16 is deflected by roughly 90° in this way such that it can enter the guide device of the vessel 1 which is bordered by walls 1 and 7 indicated in FIG. 5. For delivery of the gas GS in the pipe 16 of the nozzle a thinner pipe 18 is integrated with an outlet opening 19 which lies on the nozzle opening 17. The nozzle bodies of the nozzles can, however, project in radial direction into the guide means.

Figure 6:
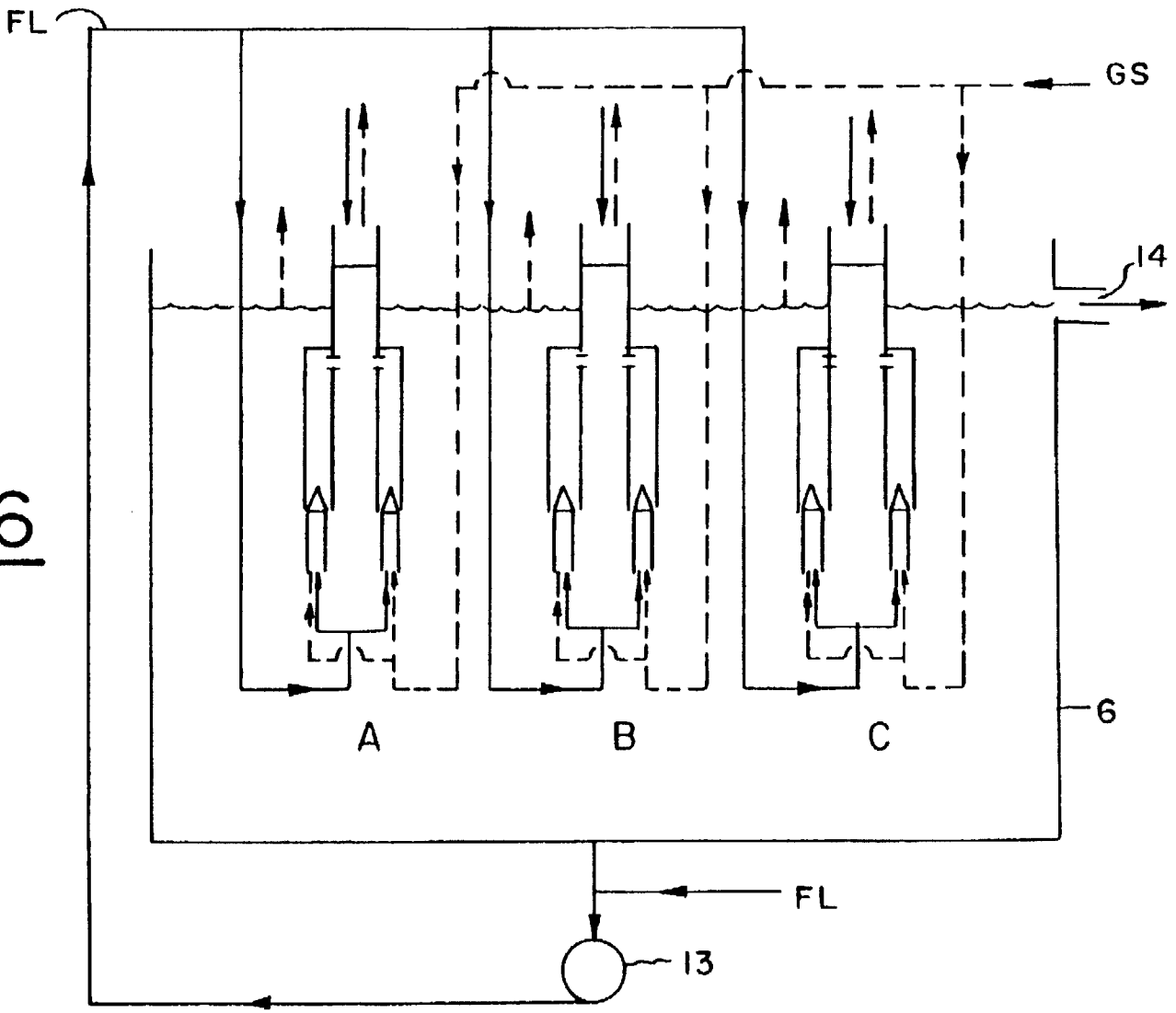
FIG. 6 shows one application for the device.
Figure 7:
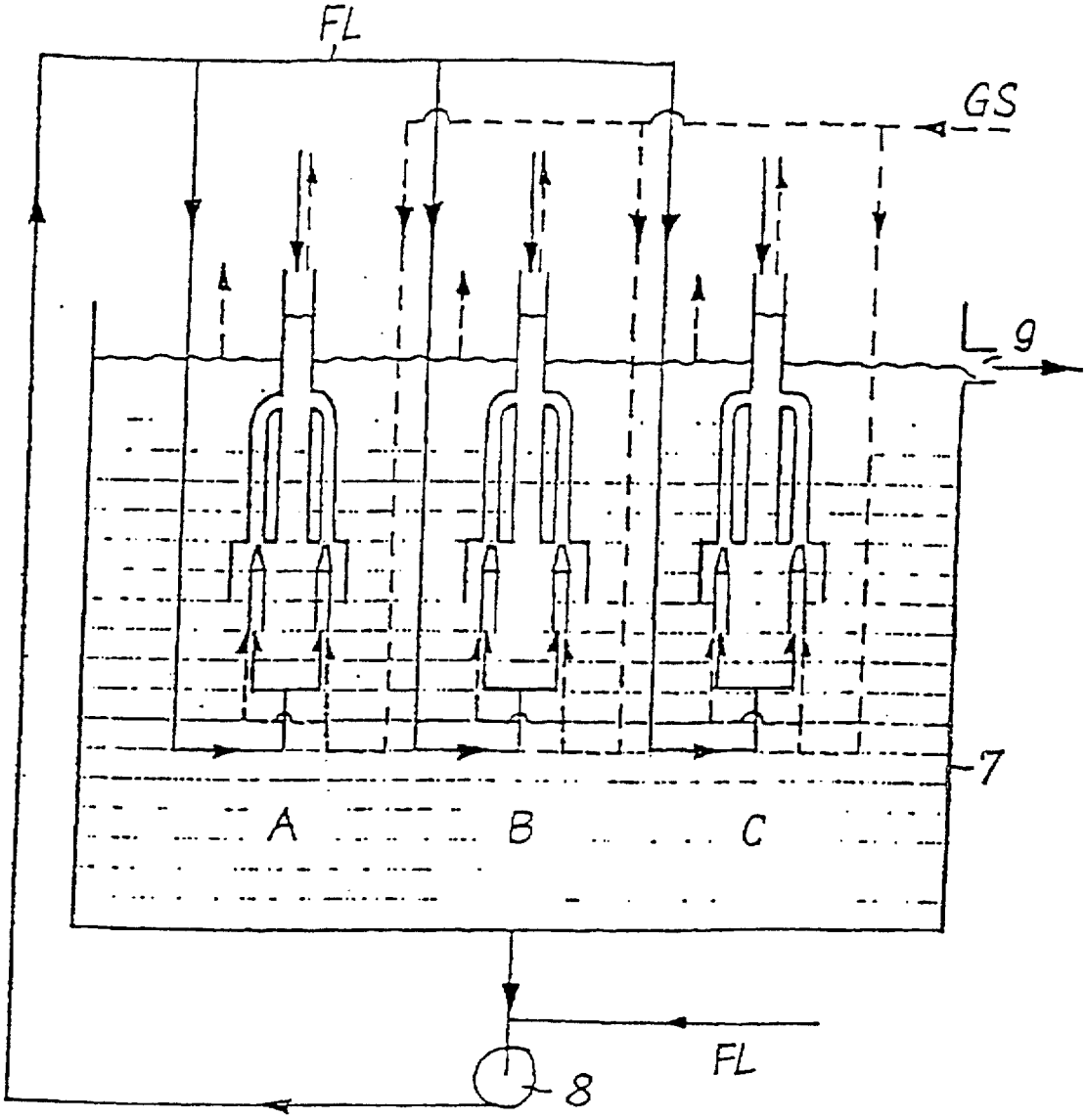
Fig. 7 Prior Art
FIG. 7 shows a prior art device.

The device described above can be directly used as such, for example, for waste water treatment. But also, as already described for FIG. 1, it can be used in a large volume tank 6 as an immersion assembly. In this case the possibility arises of using several such devices at the same time, as follows from FIG. 6 for the devices A, B, and C. This has the advantage that the device can be produced with optimum compact dimensions without consideration of the application. Only the number of devices respectively required is used as immersion assemblies.

I claim:

1. A submergible device for mixing two fluids, of which at least one is a liquid comprising a tube open on both axial ends for receiving the fluids, at least two nozzles for supplying the fluids, and a guide channel limited by walls, into which the nozzles at its one end project, and which guide channel discharges with its other end into the tube, and in which the tube, at the level of the discharge, surrounds in the middle portion of the guide channel an impact zone, in which fluid streams injected by the nozzles and emerging from the guide channel impact each other, the improvement comprising at least one wall of the guide channel is formed by a part of the wall of the tube.

2. A device according to claim 1 used as an immersion assembly for a large volume liquid tank.

3. A device according to claim 1, wherein the guide channel comprises at least two cavities which are each bordered by half-pipes which are located outside of the tube and which are connected to its wall.

4. A device according to claim 3 wherein a pipe to supply a gas as one of the fluids is integrated into the nozzle.

5. A device according to claim 3 used as an immersion assembly for a large volume liquid tank.

6. A device according to claim 1, wherein the guide channel comprises at least two cavities which are each bordered by U-shaped hollow sections which are located outside of the tube and which are connected to its wall.

7. A device according to claim 6 used as an immersion assembly for a large volume liquid tank.

8. A device according to claim 6 wherein a pipe to supply a gas as one of the fluids is integrated into the nozzle.

9. A device according to claim 1, wherein the guide channel comprises a pipe piece which is concentric to said tube and which is supported on said tube.

10. A device according to claim 9 wherein a pipe to supply a gas as one of the fluids is integrated into the nozzle.

11. A device according to claim 9 used as an immersion assembly for a large volume liquid tank.

12. A device according to claim 1 wherein a pipe to supply a gas as one of the fluids is integrated into the nozzles.

13. A device according to claim 12 used as an immersion assembly for a large volume liquid tank.

* * * * *